United States Patent [19]

Leseman et al.

[11] Patent Number: 4,817,816

[45] Date of Patent: Apr. 4, 1989

[54] EMBOSSED TAPE FOR CLOSURE SYSTEM

[75] Inventors: Steven R. Leseman, Cottage Grove; Agatona D. Monteagudo, St. Paul; Maan-Shii S. Wu, Mendota Heights, all of Minn.

[73] Assignee: Minnesota Mining and Manufacturing Company, St. Paul, Minn.

[21] Appl. No.: 197,037

[22] Filed: May 20, 1988

[51] Int. Cl.[4] ..... B65D 41/00

[52] U.S. Cl. ..... 220/359; 220/260; 220/270; 220/258

[58] Field of Search ..... 220/260, 258, 270, 359; 128/287; 206/612; 156/209; 264/284

[56] References Cited

U.S. PATENT DOCUMENTS

| | | | |
|---|---|---|---|
| 3,036,945 | 5/1962 | Souza | 154/53.5 |
| 3,389,827 | 6/1968 | Abere et al. . | |
| 3,950,480 | 4/1976 | Adams et al. | 264/284 |
| 3,990,603 | 11/1976 | Brochman | 220/260 |
| 4,237,889 | 12/1980 | Gobran | 128/287 |
| 4,244,474 | 1/1981 | Wise | 206/612 |
| 4,313,553 | 2/1982 | Lisiecki | 209/17 G |
| 4,372,460 | 2/1983 | Brochman et al. | 220/258 |
| 4,379,774 | 4/1983 | Anderson et al. | 264/284 |
| 4,390,121 | 6/1983 | Lisiecki | 229/17 G |
| 4,465,729 | 8/1984 | Cancio et al. | 428/167 |
| 4,500,011 | 2/1985 | Brockman | 220/359 |
| 4,581,087 | 4/1986 | Johnson | 156/209 |
| 4,595,116 | 6/1986 | Carlsson | 220/359 |

*Primary Examiner*—George T. Hall

*Attorney, Agent, or Firm*—Donald M. Sell; Walter N. Kirn; David L. Weinstein

[57] ABSTRACT

Easy opening closure system comprising a container and portion having an opening therein, and closure system further comprising (a) an exterior tape comprising a backing and an adhesive layer, and (b) a protection tape comprising a barrier layer and an adhesive layer bonded to said barrier layer, said protective tape being embossed.

The exterior tape is situated circumjacent the opening in the container end portion and is adhered to the top surface of the container end portion circumjacent the aforementioned opening by means of its adhesive layer. The protective tape is firmly bonded to the bottom surface of the container end portion circumjacent the aforementioned opening by means of its adhesive layer, and is firmly bonded to the exterior tape in the area of the opening by means of its adhesive layer and the adhesive layer of said exterior tape. The protective tape is embossed in order to eliminate failure between the barrier layer and adhesive layer by both creating thin, weak areas in the protective tape to facilitate puncture and increasing interfacial contact between the barrier layer and adhesive layer to improve bonding between the barrier layer and adhesive layer.

10 Claims, 1 Drawing Sheet

EMBOSSED TAPE FOR CLOSURE SYSTEM

BACKGROUND OF THE INVENTION

1. Field of the invention

This invention relates to containers having easy open closure systems.

2. Discussion of the Prior Art

Brochman, U.S. Pat. No. 4,372,460 describes an easy opening closure system comprising a container end portion having an opening therein; an exterior tape which comprises a backing and a pressure-sensitive adhesive layer and is situated circumjacent the opening; and a protective tape which comprises a barrier layer that provides a barrier to essential oils contained in beverages and an oil-resistant thermoplastic adhesive layer, the protective tape being firmly bonded to the bottom surface of the container end portion circumjacent the opening by means of the thermoplastic adhesive layer and to the exterior tape in the area of the opening by means of the pressure-sensitive adhesive layer and the thermoplastic adhesive layer. Although this type of closure system is widely used in the industry, it has been found that puncture of the barrier layer of the protective tape frequently does not occur when the closure is opened. Consequently, in order to gain access to the contents of the container, the consumer must puncture the barrier layer with a knife, fork, or like utensil. At present, failure of puncture occurs about 5 times out of every 100 containers. It is desired that this failure to puncture not occur more than 1 out of 100 attempts.

Accordingly, it is desired to provide a treatment or a modification of the closure system of the type described in U.S. Pat. No. 4,372,460 in order to minimize the above-described failure.

SUMMARY OF THE INVENTION

The present invention provides an easy opening closure system comprising a container end portion having an opening therein, said closure system further comprising:

(a) an exterior tape comprising a backing and an adhesive layer, said exterior tape being situated circumjacent said opening and being firmly adhered to the top surface of said container end portion circumjacent said opening by means of said adhesive layer; and (b) a protective tape comprising a barrier layer and an adhesive layer firmly bonded to said barrier layer, said protective tape being firmly bonded to the bottom surface of said container end portion circumjacent said opening by means of said adhesive layer of said protective tape, and further being firmly bonded to said exterior tape in the area of said opening by means of said adhesive layer of said protective tape and said adhesive layer of said exterior tape, said protective tape being embossed.

The embossing of the protective tape eliminates failure between the barrier layer and adhesive layer by both creating thin, weak areas in the protective tape to facilitate puncture and increasing interfacial contact between the barrier layer and adhesive layer to improve bonding between the barrier layer and adhesive layer.

BRIEF DESCRIPTION OF DRAWINGS

The invention is described in more detail hereinafter with reference to the accompanying drawings wherein like reference characters refer to the same part throughout the several views and in which.

DETAILED DESCRIPTION

Figure 1:
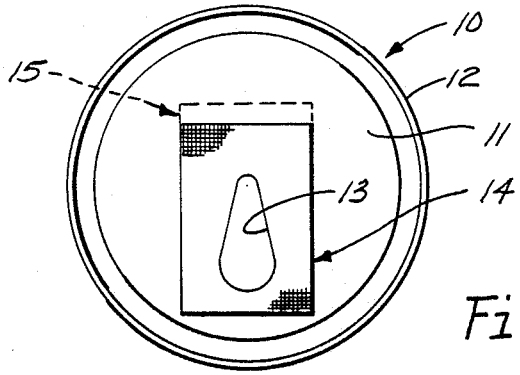
FIG. 1 is a bottom view of one embodiment of the present invention.

In FIG. 1 is shown one embodiment of a container end portion 10 (such a might be seamed onto a cylindrical, metal container body) comprising a generally flat, circular lid 11, rim 12 and preformed opening 13. Protective tape 14 is shown in one embodiment and is situated circumjacent preformed opening 13. Closure tab 15 (illustrated in phantom) is shown in one embodiment and is situated circumjacent preformed opening 13. It should be noted that alternative types of container end portions can be used in this invention. For example, instead of a flat, circular lid, a flat panel, such as those that are comprised in blanks for preparing containers, can be used. Such flat panels and containers are described, for example, in U.S. Pat. Nos. 4,244,474, 4,390,121, and 4,313,553, all of which are incorporated herein by reference.

Figure 2:
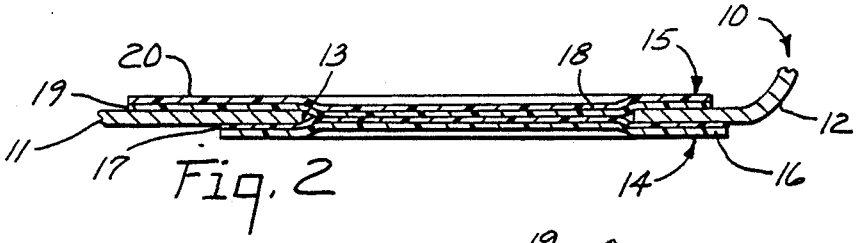
FIG. 2 is a section view taken along line 2—2 of FIG. 1.

FIG. 2 illustrates the construction of protective tape 14 and closure tab 15. Protective tape 14 comprises a barrier layer 16 which is firmly adhered to the bottom side of the container end portion 10 by means of adhesive layer 17. Closure tab 15 comprises backing member 18 which is firmly adhered to the top-side of the container end portion 10 circumjacent pour hole 13 by means of adhesive layer 19. The barrier layer 16 of protective tape 14 is firmly adhered to closure tab 15 in the area of pour hole 13 by means of adhesive layer 19 of closure tab 15 and adhesive layer 17 of protective tape 14. Protective tape 14 is embossed in such a manner so that the area of interfacial contact betwen barrier layer 16 and adhesive layer 17 is increased. This is accomplished by providing peaks and valleys in protective tape 14. Also illustrated is grip portion 20 of closure tab 15 which comprises a strip of film (not illustrated) adhered to closure tab 15 in order to prevent that portion of closure tab 15 from adhering to container end 10. Additionally, the grip portion 20 of closure tab 15 may be embossed (not illustrated) in a manner which facilitates gripping of closure tab 15.

Figure 3:
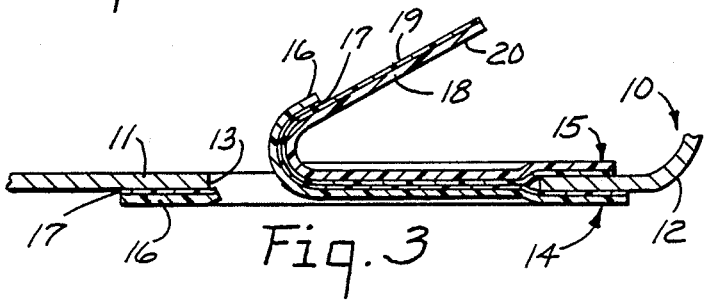
FIG. 3 is a section view similar to FIG. 2 after opening of the container has begun.

When it is desired to open the closure system depicted in FIGS. 1, 2, and 3, the consumer simply places a finger adjacent to the grip portion 20 of tab 15 and pulls that grip portion in any direction away from the container end portion 10. As closure tab 15 is removed from the container end portion 10, the portion of the protective tape 14 in the area of pour hole 13 is removed with it.

Figure 4:
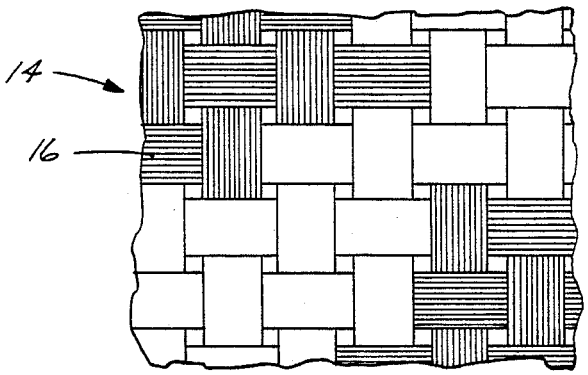
FIG. 4 is a top view, greatly enlarged, of an embossed barrier layer of the protective tape of the closure system of the present invention.

Incorporated throughout the interface between barrier layer 16 and adhesive layer 17 of protective tape 14 and evident by numerous depressions upon the surface of barrier layer 16 of protective tape 14 are a plurality of embossments. The embossments may be arranged in either a linear or other geometric pattern, or, if desired, in a random configuration. A typical pattern, greatly enlarged, is shown in FIG. 4.

The indented or depressed portions, representing the embossments are preferably clearly defined in a geometric pattern, or in some instances, exhibit an essentially irregular pattern. The embossments produced may have a depression depth that varies greatly, depending upon the material. However, it has been found that a depression depth ranging from about five to about seventy percent, preferably from ten to fifty percent, more preferably from fifteen to forty percent, of the total thickness of said protective tape is most preferable.

The effects of the application of embossing to protective tape 14 results in (a) the introduction of weakened areas in protective tape 14, said weakened areas corresponding to depressions in the tape and preferably, (b) an increase in area of interfacial contact between barrier layer 16 and adhesive layer 17 of protective tape 14. While the introduction of weakened areas reduces the amount of force required to rupture the protective tape, an increase in interfacial contact enhances interfacial bonding such that failure between barrier layer 16 and adhesive layer 17 is effectively eliminated when protective tape 14 is removed. The textured face displays a pattern of elevated areas, or comparatively thick portions, separated by valleys or comparatively thin portions. The elevated areas take the form of elongate mounds, bosses, or other protuberances (for convenience, all hereinafter referred to as "ridges"), which may be either uniform or varied in shape and dimensions, and may be distributed in either a regular or random pattern.

The embossing of protective tape 14 is effected using the known devices for embossing thermoplastics. Such devices are described, for example, in U.S. Pat. Nos. 4,237,889 and 4,581,087, incorporated herein by reference.

The embossing roller has a linear, dashed, dimpled or point-like pattern, preferably a lozenge-shaped pattern. A fine linen pattern, a shirting pattern, a pattern composed of longitudinal grooves closely adjacent to one another or patterns of this type superimposed on one another (mixed patterns). In accordance with the invention, the depth (depth of embossing) of the patterns of the embossing roller ranges from about $5\times10^{-3}$ to $25\times10^{-3}$ mm, preferably from $8\times10^{-3}$ to about $16\times10^{-3}$ mm, based on a barrier layer thickness of $25.4\times10^{-3}$ mm and an adhesive layer thickness of $33.0\times10^{-3}$ mm. The embossing pressure (linear pressure in the embossing nip) in the process according to the invention ranges from $1\times10^5$ to $5\times10^5$ Newtons per sq. meter of film ($N/m^2$), preferably from $2\times10^5$ to $4\times10^5$ $N/m^2$. The speed of the film on the embossing roller (speed of the embossing roller) ranges from 3 to 75 m/min, preferably 30 to 50 m/min.

There are three good methods of embossing protective tape 14. In the first, protective tape is first prepared and then embossed. In the second, adhesive layer 17 is coated onto a release liner; then barrier layer 16 is extrusion coated onto adhesive layer 17; the embossing step is conducted simultaneously with the extrusion coating step. In the third, adhesive layer 17 and barrier layer 16 are coextruded to form protective tape 14, which is simultaneously embossed during the coextrusion process.

In the first method, adhesive layer 17 can be coated directly onto barrier layer 16, or adhesive layer 17 can be coated on a release liner and laminated to barrier layer 16. A nip consisting of a steel roll, either wrapped with a sleeve of fibrous cloth material or having a desired embossing pattern thereon, and a rubber roll can be used to emboss the protective tape. The tape can be preheated, for example, to a temperature of 115° C. to 210° C. and passed through the nip rolls, typically maintained, for example, at a temperature of 35° C. to 65° C., to provide embossed protective tape 14. Alternatively, the unheated tape can be passed through heated nip rolls, typically maintained at a temperature of 120° C. to 210° C.

In the second method adhesive layer 17 can be hot-melt extruded onto a release liner, and immediately following, barrier layer 16 can be extrusion-coated onto adhesive layer 17 through a nip consisting of a cast roll, said roll either having a desired embossing pattern or being wrapped with a sleeve of fibrous cloth material. Alternatively, adhesive layer 17 can be either hot-melt extruded or solution-coated onto a two-side differential liner and wound up; in a separate operation, barrier layer 16 can be extrusion-coated onto adhesive layer 17 through a nip such as described previously for the first embodiment of the second method.

Tape 14 can be made by coextruding barrier layer 16 and adhesive layer 17 onto a nipped cast roll that had been wrapped with sleeve of fibrous cloth material. Coextrusion can be conducted by means of a dual-manifold die or a combination of a feed block and a single-slit die. The melt for barrier layer 16 can be brought into contact with the wrapped cast roll such that an embossed pattern is formed on the side of barrier layer 16 not bearing adhesive layer 17. A release liner can be fed to the adhesive side to prevent adhesive layer 17 from sticking to the nip roll.

Depending upon the nip roll pressure, and in the cases of extrusion and coextrusion, depending upon the temperature of materials of barrier layer 16 and adhesive layer 17, the embossed pattern can be visually discerned on the barrier layer side only or on both the barrier layer side and adhesive layer side of tape 14. After leaving the embossing roller, tape 14 is cooled further, preferably by passing it over one more cooling rollers, and is then wound up.

The interface between barrier layer 16 and adhesive layer 17 is characterized as a series of peaks and valleys The bond between barrier layer 16 and adhesive layer 17 is significantly enhanced, on account of increased interfacial area resulting from the aforementioned peaks and valleys, all other factors being unchanged. This enhanced adhesion serves to eliminate failure between barrier layer 16 and adhesive layer 17, resulting from pull-out by closure tab 15.

The embossed barrier layer 16 is characterized by an alternating series of thick and thin micro-regions, the thick micro-region being a peak and the thin micro-region being a valley. While the peaked areas provide the tape with overall integrity, the valley-like areas can be ruptured with a lower level of force, thereby reducing the requirement for bond strength to prevent separation of barrier layer 16 from adhesive layer 17 in protective tape 14.

Barrier layer 16 must have properties which permit it to be torn and removed in the area of the pour hole when closure tab 15 is removed. Thus, the tear strength of barrier layer 16 should not exceed the strength of the bond between closure tab 15 and protective tape 14. Also, the tear strength of barrier layer 16 should not exceed the strength of the bond between adhesive layer 17 and barrier layer 16 of protective tape 14. The barrier layer may be, for example, about 0.1 to 2 mil in thickness. A barrier layer 16 of about 0.5 to 1 mil in thickness is preferred in the practice of the present invention.

Suitable materials for barrier layer 16 of protective tape 14 include plastic films comprising polyolefins, e.g. polyethylene, polypropylene, and copolymers of ethylene and propylene. A particularly preferred barrier layer 16 can be prepared from low-density polyethylene, e.g., "Petrothene" 1013 polyethylene, commercially available from U.S. Industrial Chemicals Co. Other suitable materials for barrier layer 16 include thin metal foils (e.g. those comprising aluminum or tin) or metal foil-film composites.

Adhesives suitable for protective tape 14 must possess adequate tearing characteristics in order to assure complete removal when closure tab 15 is removed. Generally, an adhesive coating of about 0.5 to 3 mils in thickness is suitable in the practice of the present invention. Adhesives suitable for layer 17 include copolymers of styrene and isoprene, copolymers of styrene and butadiene, copolymers of ethylene and vinyl acetate, copolyesters, terpolymers of ethylene, vinyl acetate, and acrylic acid, and polyester-urethane elastomers. A particularly preferred pressure-sensitive adhesive comprises block copolymer of styrene and isoprene (98 parts by weight), hydrocarbon tackifying resin (80 parts by weight), antioxidant (0.5 part by weight), titanium dioxide pigmented block copolymer of styrene and isoprene, (7 parts by weight)

A preferred protective tape 14 comprises a 0.8 mil (12.5 micrometers) barrier layer 16 prepared from low-density polyethylene ("Petrothene" 1013) and a 1.5 mil adhesive layer comprising the aforementioned block copolymer.

Closure tab 15 may comprise the various materials which are well known in the art for tape backings, adhesives, primers, and the like. Particularly suitable materials for tapes which are to be used as container closures have been described in U.S. Pat. Nos. 3,389,827 and 3,990,603, incorporated herein by reference, and are discussed below.

Backing member 18 of closure tab 15 preferably can be up to about 20 mils (500 micrometers) and most preferably about 1 to 10 mils (25 to 250 micrometers) in thickness and it should be capable of being pulled back upon itself without rupture. As a practical matter the backing preferably has a uniform thickness across its width and along its length. To provide a closure which will withstand the forces exerted on it with an adequate margin of safety, the backing material at a width of one inch (2.54 cm) should have a strength at break of at least 15 pounds (6.8 kg).

Representative materials which have been found suitable as backing members 18 include tough plastic films which have been oriented and heat-set in manners which are well known in the art in order to impart requisite properties of toughness and heat-resistance. Suitable films include polyesters, e.g. polyethylene terephthalate, polytetramethylene terephthalate, blends of polytetramethylene terephthalate/polyethylene, blends of polytetramethylene terephthalate/polyethylene terephthalate, and polyethylene terephthalate/polyethylene composites. A particularly suitable film is a 2-mil (50 micrometer) biaxially-oriented film of polyethylene terephthalate. Other representative materials include thin metal foils (e.g. aluminum, steel, etc.) as well as metal foil-film composites.

Tapes useful as closure tab 15 have an adhesive layer 19 which will withstand a dead shear load of 8.8 psi (60.7 kPa) at 140° F. (60° C.) for at least 1000 minutes. This shear strength test is described in said U.S. Pat. No. 3,389,827.

Preferred adhesives are pressure-sensitive adhesives such as the block copolymer-containing adhesives described in U S. Pat. No. 3,389,827. Preferred block copolymers are those having the general configuration A-B-A, wherein each A is a thermoplastic polymer block having a glass transition temperature above room temperature and having an average molecular weight between about 5,000 and 125,000, and B is a polymer block of a conjugated diene having an average molecular weight between about 15,000 and 250,000.

One particularly suitable pressure-sensitive adhesive of this type comprises 100 parts by weight of "Kraton" 1101 (a block copolymer of styrene and butadiene having one butadiene polymer block of 70,000 molecular weight and two styrene polymer blocks of 15,000 molecular weight, commercially available from Shell Oil Company), 76 parts by weight of "Piccolyte"A-135 (an alpha-pinene resin, commercially available from Hercules Incorporated) and 0.8 parts by weight of "Ethanox Antioxidant 330" (1,3,5-trimethy-2,4,6-tris(3,5-ditert-butyl-4-hydroxybenzyl) benzene), commercially available from Ethyl Corporation.

Employment of a primer, while optional, is desirable in order to assure secure bonding of the adhesive layer to the tape backing. A particularly suitable primer for use with the preferred polyethylene terephthalate film backing is the linear saturated soluble polyester which is available under the trade designation "Vitel PE 222" from the B.F. Goodrich Co. This polyester comprises the following residues (amounts indicated in a molar basis): terephthalic acid (23%), isophthalic acid (21%), aliphatic diacids (7%), ethylene glycol (27%), and neopentyl glycol (21%).

The tab can be rendered opaque by means of pigmentation of the tape backing as the backing is extruded, by means of vapor coating the tape backing with a thin layer of metal (e.g. aluminum, silver, copper, etc.), or by means of coating a dispersion of pigment onto the tape backing. A vapor coat may be desirable since it functions to improve the impermeability (e.g. to air and moisture) of the film backing. In the case of a vapor coat, it is often desirable to apply a top coat over the vapor coat in order that the latter be protected from any abrasion which can cause an undesirable appearance of the tab. One particularly useful material for a topcoat is "Vitel PE 222" polyester, discussed above as also being a suitable primer.

METHODS FOR EVALUATING TAPE BOND BETWEEN BARRIER LAYER 16 AND ADHESIVE LAYER 17

A strip of Scotchtab ® brand peel-open closure tape is bonded to both the film and adhesive sides of the embossed tape. Separation of film and adhesive is manually initiated, followed by peeling the film and adhesive apart on an Instron tensile tester at a speed of 12 inches per minute. The combination of high bond strength and weak film very often causes premature film breaking. When premature breaking occurs, no bond values are recorded.

PUNCTURE

A strip of the embossed tape is mounted on a frame supported at the lower jaw of an "Instron" tensile tester. A solid metallic capsule mounted on the upper jaw of the tensile tester is driven upwardly at a rate of 5 inches per minute to puncture the mounted tape at an angle of 30° relative to the tape surface. The values recorded are puncture force and puncture elongation at break.

ADHESION

Tape is peeled from polyethylene surface at a peel angle of 150° at a speed of 12 inches per minute.

CALIPER

Tape caliper is measured with a thickness gauge. The value recorded is peak area in the embossed tape.

PULLOUT

The purpose of this test is to observe the closure under simulated operating conditions.

Taped can ends are heated for 15 seconds in boiling water, cooled to room temperature, and the tabs are then peeled in the conventional manner.

Feathering of the tape is recorded on the basis of a visual scale, ranging from 1 to 8, the values 1, 2, 3, and 4 being acceptable, and the values 5, 6, 7, and 8 being unacceptable. A failure between barrier layer 16 and adhesive layer 17 is indicated by the symbol *.

EXAMPLE I

In this example conventional protective tape was prepared by coating a solution containing an adhesive onto a silicone-coated paper liner. The adhesive-containing solution had the following formulation:

| Ingredient | Parts by weight |
|---|---|
| Block copolymer (rubber) ("Kraton" 1107, Shell Oil Co.) | 100 |
| Tackifying resin ("Nevtac" 100, Neville Chemical Company) | 78.31 |
| Titanium dioxide | 4.88 |
| Antioxidant ("Ethanox Antioxidant 330", Ethyl Corporation) | 1.71 |
| Toluene | 227.27 |

Upon drying, the coating had a thickness of 1.3 mil. Then a 1.0 mil low density polyethylene film having a surface tension of 32 ergs/cm$^2$ was laminated to the adhesive layer, and the resulting protective tape wound up.

The film side of a strip of the protective tape was brought in contact for 10 seconds with a piece of woven fiber cloth under a temperature of 115° C. at a pressure of $2.76\times10^5$ N/m$^2$.

COMPARATIVE EXAMPLE A

Example I was repeated with the only exception being that no woven fiber cloth was used in the heat embossing step.

COMPARATIVE EXAMPLE B

Example I was repeated with the only exceptions being that no woven fiber cloth was used and no heat embossing step was used.

EXAMPLE II

Example I was repeated with the only exception being that the polyethylene film backing was corona treated prior to being laminated to the adhesive.

COMPARATIVE EXAMPLE C

Example II was repeated, with the only exception being that no woven fiber cloth was used in the heat embossing step.

COMPARATIVE EXAMPLE D

Example II was repeated with the only exceptions being that no woven fiber cloth was used and no heat embossing step was used.

The tapes of Examples I and II and Comparative Examples A, B, C, and D were tested as described previously, and the results are shown in Table 1.

EXAMPLE III

Example II was repeated with the only exception being that the embossing step was carried out by means of a nip rather than by means of a heat sealer.

The nip consisted of a steel roll either wrapped with a piece of woven fiber cloth or having a desired embossing pattern and a rubber roll.

The tape was preheated to 115° C. and passed through the nip rolls, which were maintained at 82° C. Nip roll pressure was $3.45\times10^5$ N/m$^2$.

COMPARATIVE EXAMPLE E

Example III was repeated with the sole exception being that no embossing pattern was applied; however, the tape was preheated, and the nip rolls were also maintained at elevated temperature.

COMPARATIVE EXAMPLE F

Example III was repeated with the only exceptions being that no embossing pattern was applied and no heat embossing step was used.

EXAMPLE IV

Protective tape was prepared by extrusion coating 1.0 mil polyethylene film onto 1.3 mil hot melt adhesive having the following formulation:

| Ingredient | Amount (parts by weight) |
|---|---|
| Block copolymer ("Kraton" 1107, Shell Oil Company) | 98 |
| Tackifying resin ("Escorez" 1310, Exxon Corporation) | 80 |
| Antioxidant ("Ethanox Antioxidant 330", Ethyl Corporation) | 0.50 |
| Titanium pigmented rubber (70% $TiO_2$; 30% "Kraton" 1107, Shell Oil Company) | 7 |

The adhesive was hot melt extruded onto a two-sided differential liner and wound up. In a separate operation, the polyethylene film was extrusion coated on the adhesive layer through a nip consisting of a cast roll either having desired embossing pattern or being wrapped with a piece of woven fiber cloth. The melt temperature of the polyethylene extrudate was 210° C. and the nip roll was heated to 82° C.

EXAMPLE V

Example IV was repeated, with the sole exception being that a different embossing pattern was used.

COMPARATIVE EXAMPLE G

Example IV was repeated, with the sole exception that no embossing pattern was applied.

EXAMPLE VI

A barrier layer of polyethylene film and a layer of adhesive having the formulation of the adhesive of Example IV were coextruded onto a nipped cast roll either having a desired embossing pattern or being wrapped with a piece of woven fiber cloth. The melt of polyethylene film was brought into contact with the cast roll while a release liner was fed to the adhesive side of the tape to prevent it from sticking to the nip roll. A high nip roll pressure was applied in order to give a deep embossed pattern.

EXAMPLE VII

Example VI was repeated, with the sole exception being that low nip roll pressure was applied to produce a shallow embossed pattern.

TABLE I

| Example No. | Bond strength (oz/0.5 in) | Puncture strength (oz) | Puncture elongation (%) | Peel strength (oz/in) | Caliper (mil) | Pullout | Embossing conditions Temp. (°C.) | Embossing conditions Pressure ($N/m^2$) | Web speed (m/min) |
|---|---|---|---|---|---|---|---|---|---|
| I | 25.0 | 26.5 | 10 | 14.0 | 2.90 | 1-3 | 115 | $2.76 \times 10^5$ | |
| Comp. A | 21.5 | 43.0 | 15 | 14.0 | 2.20 | | | | |
| Comp. B | 19.0 | 52.5 | 19 | 14.0 | 2.30 | 7*,8* | | | |
| II | 36.0 | 37.0 | 12 | 10.2 | 2.90 | 1-2 | 115 | $0.69 \times 10^5$ | |
| Comp. C | Break | 52.0 | 20 | 10.2 | | | | | |
| Comp. D | 29.0 | 54.3 | 16 | 14.8 | 2.30 | 1-3,7* | | | |
| III | Break | 25.9 | 9 | 12.2 | 2.60 | 1-2 | | $3.45 \times 10^5$ | 4 |
| Comp. E | 33.2 | 55.6 | 20 | 16.6 | 2.40 | | | | |
| Comp. F | 31.0 | 55.0 | 18 | 14.8 | 2.30 | | | | |
| IV | Break | 29.0 | 20 | 14.0 | 2.90 | 1-2 | 204 | $4.0 \times 10^5$ | 11 |
| V | Break | 22.5 | 11 | 12.0 | 3.10 | 1-2 | 204 | $4.0 \times 10^5$ | 11 |
| Comp. G | Break | 38.0 | 33 | 14.0 | 2.10 | | | | |
| VI | 30.4 | 51.3 | 10 | 3.4 | 3.80 | 4,8* | | | |
| VII | 20.0 | 51.7 | 11 | 5.6 | 3.20 | 2-3 | | | |

EXAMPLE VIII

Example III was repeated, with the sole exception being that the tape was not preheated and the nip rolls were maintained at elevated temperatures. In this example nine runs were made. Embossing roll temperature and web speeds were varied. Results from the nine runs of this example are set forth in Table II. Comparative Example H was prepared in substantially the same manner as was used to prepare Comparative Example D.

TABLE II

| Run no. | Bond strength (oz/0.5 in) | Puncture strength (oz) | Puncture elongation (%) | Peel strength (oz/in) | Caliper (mil) | Pullout | Embossing conditions Temp. (°C.) | Embossing conditions Pressure ($N/m^2$) | Web speed (m/min) |
|---|---|---|---|---|---|---|---|---|---|
| 1 | Break | 39.7 | 10 | 18.2 | 2.71 | 1-2 | 154 | $2.76 \times 10^3$ | 32 |
| 2 | Break | 45.0 | 11 | 16.3 | 2.70 | 1-2 | 149 | $2.76 \times 10^3$ | 32 |
| 3 | Break | 41.3 | 10 | 16.8 | 2.72 | 2 | 149 | $2.76 \times 10^3$ | 23 |
| 4 | Break | 45.3 | 10 | 15.2 | 2.81 | 1-2 | 138 | $2.76 \times 10^3$ | 23 |
| 5 | Break | 44.7 | 11 | 16.1 | 2.65 | 1-2 | 138 | $2.76 \times 10^3$ | 23 |
| 6 | Break | 47.7 | 14 | 17.6 | 2.65 | 1-3 | 132 | $2.76 \times 10^3$ | 23 |
| 7 | Break | 46.7 | 15 | 17.0 | 2.62 | 1-3 | 124 | $2.76 \times 10^3$ | 23 |
| 8 | Break | 33.3 | 10 | 17.4 | 2.60 | 1-3 | 124 | $2.76 \times 10^3$ | 14 |
| 9 | Break | 39.7 | 11 | 17.4 | 2.71 | 1-2 | 127 | $2.76 \times 10^3$ | 9 |
| Comp. H | 30.0 | 54.3 | 16 | 14.8 | 2.40 | 1-3,7* | | | |

Various modifications and alterations of this invention will become apparent to those skilled in the art without departing from the scope and spirit of this invention, and it should be understood that this invention is not to be unduly limited to the illustrative embodiment set forth herein.

What is claimed is:

1. Closure system comprising a container end portion having an opening therein, (a) an exterior tape comprising a backing and an adhesive layer, said exterior tape being situated circumjacent said opening and being firmly adhered to the top surface of said container end portion circumjacent said opening by means of said adhesive layer; and (b) a protective tape comprising a barrier layer and an adhesive layer firmly bonded to said barrier layer, said protective tape being firmly bonded to the bottom surface of said container end portion circumjacent said opening by means of said adhesive layer of said protective tape, and further being firmly bonded to said exterior tape in the area of said opening by means of said adhesive layer of said protective tape and said adhesive layer of said exterior tape, said protective tape being embossed.

2. The closure system of claim 1 wherein said embossed protective tape is uniformly embossed.

3. The closure system of claim 1 wherein said embossed protective tape has been embossed such that the depth of the depressions resulting from embossment range from about 5 to about 70% of the thickness of the protective tape.

4. The closure system of claim 1 wherein said embossed protective tape has been embossed such that the depth of the depressions resulting from embossment range from about 10 to about 50% of the thickness of the protective tape.

5. The closure system of claim 1 wherein said embossed protective tape has been embossed such that the depth of the depressions resulting from embossment range from about 15 to about 40% of the thickness of the protective tape.

6. The closure system of claim 1 wherein at least 50% of the surface area of said barrier layer is embossed.

7. The closure system of claim 1 wherein said container end portion is a flat, circular lid.

8. The closure system of claim 1 wherein said container end portion is a flat panel.

9. The closure system of claim 8 wherein said flat panel is part of a blank for preparing a container.

10. A container comprising the closure system of claim 1.

* * * * *

UNITED STATES PATENT AND TRADEMARK OFFICE

CERTIFICATE OF CORRECTION

PATENT NO. : 4,817,816

DATED : April 4, 1989

INVENTOR(S) : Leseman et al.

It is certified that error appears in the above-identified patent and that said Letters Patent is hereby corrected as shown below:

In the Abstract, Line 2, "and portion" should read --end portion--.

In the Abstract, Line 2, "and closure" should read --said closure--.

In Column 2, Line 15, "a might" should read --as might--.

In Column 10, Line 58 (Table II, Run no. 4, Temp.), "138" should read --143--.

Signed and Sealed this

Twenty-first Day of August, 1990

*Attest:*

HARRY F. MANBECK, JR.

*Attesting Officer*

*Commissioner of Patents and Trademarks*